US006738603B1

(12) United States Patent
Saito

(10) Patent No.: US 6,738,603 B1
(45) Date of Patent: May 18, 2004

(54) RADIO COMMUNICATION APPARATUS WITH RETRACTABLE ANTENNA AND ITS IMPEDANCE MATCHING METHOD

(75) Inventor: Tetsuya Saito, Saitama (JP)

(73) Assignee: NEC Corporation, Tokyo (JP)

( * ) Notice: Subject to any disclaimer, the term of this patent is extended or adjusted under 35 U.S.C. 154(b) by 667 days.

(21) Appl. No.: 09/590,844

(22) Filed: Jun. 9, 2000

(30) Foreign Application Priority Data

Jun. 10, 1999 (JP) ..... 11-163719

(51) Int. Cl.[7] ..... H01Q 1/24

(52) U.S. Cl. ..... 455/90.1; 455/575.1; 455/128; 455/129; 455/550.1; 343/895; 333/173; 333/32; 333/124

(58) Field of Search ..... 455/90, 550, 128, 455/351, 90.1, 550.1, 129, 575.7; 343/702, 895; 333/124, 17.3, 32, 173

(56) References Cited

U.S. PATENT DOCUMENTS

| | | | | |
|---|---|---|---|---|
| 5,739,792 A | * | 4/1998 | Hassemer et al. | 343/702 |
| 5,818,392 A | | 10/1998 | Oka et al. | |
| 5,856,808 A | | 1/1999 | Holshouser et al. | |
| 5,986,607 A | * | 11/1999 | Rudisill | 343/702 |
| 5,995,050 A | * | 11/1999 | Moller et al. | 343/702 |
| 6,006,117 A | * | 12/1999 | Hageltorn et al. | 455/575.7 |
| 6,239,755 B1 | * | 5/2001 | Klemens et al. | 343/702 |
| 6,351,241 B1 | * | 2/2002 | Wass | 343/702 |

FOREIGN PATENT DOCUMENTS

| | | |
|---|---|---|
| EP | 0 685 936 A2 | 12/1995 |
| JP | 1-160101 | 6/1989 |
| JP | 9-116457 | 5/1997 |
| JP | 2000-286924 | 10/2000 |
| JP | 2000-341015 | 12/2000 |
| WO | WO 92/16980 | 10/1992 |
| WO | WO 96/37967 | 11/1996 |

OTHER PUBLICATIONS

Patent Abstractsof Japan: vol. 016, No. 517 (E–1284), Oct. 23, 1992 and JP 04 192850A (Canon, Inc.) dat ed Jul. 13, 1992.

* cited by examiner

*Primary Examiner*—Nay Maung
*Assistant Examiner*—Alan T. Gantt
(74) *Attorney, Agent, or Firm*—Scully, Scott, Murphy & Presser

(57) ABSTRACT

A radio communication apparatus is provided, which realizes a desired impedance matching state between a retractable antenna and a circuit connected thereto in both a situation where the antenna environment is similar to a free space and a situation where the antenna environment is dissimilar from a free space. The apparatus comprises (a) a casing; (b) a retractable antenna having first and second elements joined together; the second element being connected to an internal, circuit provided in the casing; (c) a terminal matching circuit for matching an impedance of the antenna to that of the internal circuit in a first situation where an environment of the antenna is similar to a free space and a second situation where an environment of the antenna is dissimilar from a free space; the terminal matching circuit being configured to provide at least two terminal impedance values for the antenna; and (d) a control circuit for controlling an operation of the terminal matching circuit corresponding to whether the apparatus is placed in the first situation or the second situation; the control circuit controlling the terminal matching circuit in such a way that a first one of the at least two terminal impedance values is selected when the apparatus is placed in the first situation and a second one of the at least two terminal impedance values is selected when the apparatus is placed in the second situation.

18 Claims, 8 Drawing Sheets

RADIO COMMUNICATION APPARATUS WITH RETRACTABLE ANTENNA AND ITS IMPEDANCE MATCHING METHOD

BACKGROUND OF THE INVENTION

1. Field of the Invention

The present invention relates to a radio communication apparatus and an impedance matching method and more particularly, to a radio communication apparatus with a retractable antenna and an impedance matching method of a radio communication apparatus of this sort, which make it possible to match the impedance between the antenna and the circuit connected to the antenna in a situation where the antenna environment is similar to a free space and another situation where the antenna environment is dissimilar from a free space.

2. Description of the Related Art

The portable telephone, which is a typical one of radio communication apparatuses, has several operation states, such as the stand-by state for waiting incoming messages or data, the dial-inputting state for inputting phone numbers, and the communication state for the transmission or reception operation. These operation states can be categorized into two classes, i.e., the "communication states" where the telephone performs the transmission or reception operation and the "non-communication" states where the telephone does not perform the transmission or reception operation.

In the "non-communication states", the environment of the antenna is similar to a free space and therefore, it can be approximated as a free space. In the "communication states", however, the environment of the antenna is not similar to a free space. This is because the telephone is often used in a location near the head of the user for the purpose of exchanging voice messages using the microphone and receiver on the telephone. Thus, it is typical that the environment of the antenna is unable to be approximated as a free space in the communication states.

Moreover, considering the state that the telephone is used for data transmission, this state belongs to the "communication states"; in this state, however, the telephone is usually used in a location far from the head of the user. This is because the microphone and receiver for exchanging voice messages is not necessary and because the telephone is usually operated along with a portable computer. As a result, the environment of the antenna can be approximated as a free space in the data transmission state.

Accordingly, if the operation states of the telephone are classified with respect to the environment of the antenna, they are categorized into two situations, i.e., the first situation similar to a free space and the second situation dissimilar from a free space. Thus, the input impedance of the antenna needs to be changed according to which one of these two situations is applicable.

Additionally, the antenna of the portable telephone is usually retractable and therefore, the environment of the antenna varies according to whether or not the antenna is retracted into the casing too.

Taking the above-described change in the antenna environment into consideration, conventionally, the configuration of portable telephones has been designed and developed. This is applicable to any other radio communication apparatuses having a retractable antenna.

FIG. 1 shows schematically the configuration of a prior-art radio communication apparatus, which is configured as a portable telephone.

As shown in FIG. 1, the prior-art radio communication apparatus 101 comprises a whip antenna 102, a matching circuit 105, a switch 106 with three terminals for switching the transmission and reception operations, a terminal matching circuit 107, a transmission circuit 111, a reception circuit 112, a control circuit 113, and a casing 120. The matching circuit 105, the switch 106, the terminal matching circuit 107, the transmission circuit 111, the reception circuit 112, and the control circuit 113 are located in the casing 120. The antenna 102 is fixed to the casing 120 so as to be retractable into the casing 120.

The whip antenna 102 includes a straight element 104 and a helical element 103. The straight element 104 is supported by the casing 120 so as to be extendable from the casing 120 to the outside and retractable into its inside. The helical element 103 is connected in series to the straight element 104. The antenna 102 emits a transmitting signal TS supplied from the transmission circuit 111 in the form of a radio wave and generates a reception signal RS from a radio wave received from the outside.

In the state where the straight element 104 is retracted into the casing 120 (which may be said that the whip antenna 102 is retracted hereinafter), only the helical element 103 protrudes from the casing 120. On the other hand, in the state where the straight element 104 is extended to the outside of the casing 120 (which may be said that the whip antenna 102 is extended hereinafter), both the helical and straight elements 103 and 104 protrude from the casing 120.

One terminal of the terminal matching circuit 107 is connected to a connector 121 and the other terminal thereof is connected to the ground. The circuit 107 has predetermined, specific impedance.

One terminal of the matching circuit 105 is connected to a connector 122 and the other terminal thereof is connected to a first terminal of the switch 106. The circuit 105 serves to match the impedance between the antenna 102 and the transmission or reception circuit 111 or 112.

When the whip antenna 102 is retracted into the casing 120, as shown in FIG. 1, the bottom end of the straight element 104 is contacted with the connector 121. Thus, the terminal matching circuit 107 is connected to the bottom end of the element 104. The upper part of the element 104 is contacted with the connector 122, thereby connecting the matching circuit 105 to the element 104.

When the whip antenna 102 is extending from the casing 120, the bottom end of the straight element 104 is apart from the connector 121 and as a result, the terminal matching circuit 107 is disconnected from the element 104. The element 104 is kept in contact with the connector 122 and as a result, the matching circuit 105 is kept connected to the element 104 in this state.

The second and third terminals of the switch 106 are connected to the output terminal of the transmission circuit 111 and the input terminal of the reception circuit 112, respectively. The switch 106 alternately connects one of the transmission and reception circuits 111 and 112 to the matching circuit 105.

The transmission circuit 111 generates the transmission signal TS by modulating the carrier wave with specific transmission data. The data TS is outputted from the output terminal of the circuit 111 to the whip antenna 102 by way of the switch 106 and the matching circuit 105. The operation of the circuit 111 is controlled by a transmission control signal TCS supplied from the control circuit 113.

The reception signal RS, which is generated by the antenna 102, is inputted into the input terminal of the reception circuit 112 by way of the matching circuit 105 and the switch 106. The reception circuit 112 demodulates the reception signal RS thus supplied and extracts the data contained in the signal RS. The operation of the circuit 112 is controlled by the reception control signal RS.

If the reception signal RS contains a disconnection signal DCS, the reception circuit 112 outputs the signal DCS to the control circuit 113. In this case, the circuit 113 stops the reception operation of the circuit 112 using the control signal RCS.

The control circuit 113 generates the switch control signal SCS, the transmission control signal TCS, and the reception control signal RCS and then, supplied them to the switch 106, the transmission circuit 111, and the reception circuit 112, respectively.

The prior-art radio communication apparatus 101 operates in the following way.

On signal transmission, the switch 106 is operated to connect the transmission circuit 111 to the matching circuit 105. The transmission signal TS outputted from the transmission circuit 111 is supplied to the whip antenna 102 through the matching circuit 105 and the switch 106. The signal TS thus supplied is emitted to the outside or the air in the form of radio wave.

On signal reception, the switch 106 is operated to connect the reception circuit 112 to the matching circuit 105. The reception signal RS supplied from the antenna 102 is inputted into the reception circuit 112 through the matching circuit 105 and the switch 106. The signal RS thus inputted is demodulated to extract the data contained therein.

Thus, according to the switch control signal SCS from the control circuit 113, the electrical connection to the antenna 102 is switched to the transmission or reception circuit 111 or 112.

As explained above, when the whip antenna 102 is extended, both the helical and straight elements 103 and 104 of the whip antenna 102 protrude from the casing 120. As a result, both the elements 103 and 104 provide the specific antenna function. In this state, the terminal matching circuit 107 is inactive and therefore, only the matching circuit 105 provides the impedance matching function between the antenna 102 and the reception or transmission circuit 111 or 112.

On the other hand, when the whip antenna 102 is retracted, only the helical element 103 protrudes from the casing 120. As a result, only the element 103 provides the specific antenna function. In this state, the terminal matching circuit 107 is active and compensates the input impedance of the antenna 102. In other words, when only the helical element 103 is available, the input impedance of the antenna 102 is compensated so as to match the impedance between the antenna 102 and the reception or transmission circuit 111 or 112. Thus, like the state where the whip antenna 102 is extended, the impedance matching operation between the antenna 102 and the reception or transmission circuit 111 or 112 is accomplished by the matching circuit 105.

Usually, the matching circuit 105 is adjusted in such as way that the impedance is optimized or matched between the antenna 102 and the reception or transmission circuit 111 or 112 when the whip antenna 102 is extended. This adjustment for desired impedance matching is accomplished under the supposition that the antenna 2 is placed in a free space (i.e., in the first situation).

In the state where the apparatus 101 is located in the vicinity of the head of the user (i.e., in the second situation), however, the input impedance of the helical element 103 varies due to the effect of the head. Thus, the impedance matching condition will deviate. The deviation in impedance matching condition when the antenna 102 is retracted is larger than that when the antenna 102 is extended.

FIG. 2 is a Smith chart indicating the input impedance of the whip antenna 102 (substantially, the helical element 103) in the second situation where the apparatus 101 is located near the head of the user. As seen from FIG. 2, the curve a1 showing the input impedance of the antenna 102 is shifted below from the center line b1, which means that the input impedance characteristic has degraded.

FIG. 3 is a graph showing the return loss characteristic between the antenna 102 (substantially, the helical element 103) and the transmission or reception circuit 111 or 112 in the second situation. As seen from FIG. 3, the return loss is greater than the reference value of −5 dB for transmission and reception within the frequency range W1. This means that the return loss is excessively large.

If the impedance matching is determined to appear in the second situation where the environment of the antenna 102 is dissimilar from a free space, the above-described characteristic degradation can be avoided. In this case, however, there arise a problem that the input impedance is not optimized in the first situation where the environment of the antenna 102 is similar to a free space.

Accordingly, when the whip antenna 102 is retracted into the casing 120, it is difficult to realize desired impedance matching in both the first and second situations. This means that the impedance matching is not accomplished in any one of these two situations.

Recently, there has been the strong trend to further miniaturize portable radio communication apparatuses such as portable telephones and as a result, the distance of the helical element 103 from the head of the user has been decreasing. Thus, the impedance characteristic of the antenna 102 in the above-described first and second situations tends to vary or fluctuate in a wider range and the return loss tends to be more conspicuous.

SUMMARY OF THE INVENTION

Accordingly, an object of the present invention is to provide a radio communication apparatus and an impedance matching method thereof that realize a desired impedance matching state between a retractable antenna and a circuit connected thereto in both a situation where the antenna environment is dissimilar from a free space.

Another object of the present invention is to provide a radio communication apparatus and an impedance matching method thereof that realize a desired impedance matching state between a retractable antenna and a circuit connected thereto even when the antenna is retracted.

Still another object of the present invention is to provide a radio communication apparatus and an impedance matching method thereof that that decrease the return loss of a retractable antenna in each of a situation where the antenna environment is similar to a free space and a situation where the antenna environment is dissimilar from a free space.

The above objects together with others not specifically mentioned will become clear to those skilled in the art from the following description.

According to a first aspect of the present invention, a radio communication apparatus is provided, which comprises:

(a) a casing;

(b) an antenna retractable into the casing;

the antenna having a first element and a second element joined together;

the first element being placed outside even when the antenna is retracted;

the second element being retracted into the casing when the antenna is retracted;

the second element being connected to an internal circuit provided in the casing;

(c) a terminal matching circuit for matching an impedance of the antenna to that of the internal circuit in a first situation where an environment of the antenna is similar to a free space and a second situation where an environment of the antenna is dissimilar from a free space;

the terminal matching circuit being configured to provide at least two terminal impedance values for the antenna; and (d) a control circuit for controlling an operation of the terminal matching circuit corresponding to whether the apparatus is placed in the first situation or the second situation;

the control circuit controlling the terminal matching circuit in such a way that a first one of the at least two terminal impedance values is selected when the apparatus is placed in the first situation and a second one of the at least two terminal impedance values is selected when the apparatus is placed in the second situation.

With the radio communication apparatus according to the first aspect of the invention, the terminal matching circuit is provided for matching the impedance of the retractable antenna to the internal circuit in the first situation where an environment of the antenna is similar to a free space and the second situation where an environment of the antenna is dissimilar from a free space. The terminal matching circuit is configured to provide at least two terminal impedance values for the circuit.

Moreover, the control circuit is provided for controlling the operation of the terminal matching circuit corresponding to whether the apparatus is placed in the first situation or the second situation. The control circuit controls the terminal matching circuit in such a way that the first one of the at least two terminal impedance values is selected when the apparatus is placed in the first situation and the second one of the at least two terminal impedance values is selected when the apparatus is placed in the second situation.

As a result, a desired impedance matching state between the retractable antenna and the inner circuit connected thereto can be realized in each of the first situation where the antenna environment is similar to a free space and the second situation where the antenna environment is dissimilar from a free space.

Because of the impedance matching, the return loss of the antenna can be decreased.

If the at least two terminal impedance values for the antenna are properly set to meet the requirement when the antenna is retracted into the casing or not, a desired impedance matching state between the retractable antenna and the inner circuit can be realized in each of the first and second situations independent of whether the antenna is retracted or not.

In a preferred embodiment of the apparatus according to the first aspect of the invention, the terminal matching circuit comprises a first termination subcircuit, a second termination subcircuit, and a switch for switching the first and second termination subcircuit by a control signal from the control circuit.

In this embodiment, preferably, the first termination subcircuit is connected to the second element of the antenna when the apparatus is in the first situation, and the second termination subcircuit is connected to the second element of the antenna when the apparatus is in the second situation.

Alternately, the first termination subcircuit is connected to the second element of the antenna when the apparatus is in the first situation, and the first and second termination subcircuits are connected to the second element of the antenna when the apparatus is in the second situation.

In another preferred embodiment of the apparatus according to the first aspect of the invention, the first situation includes a stand-by state and a data communication state of the apparatus and the second situation includes a voice message exchange state.

In still another preferred embodiment of the apparatus according to the first aspect of the invention, an earphone detection circuit outputting an earphone detection signal to the control circuit is additionally provided. The control circuit controls the terminal matching circuit responsive to the earphone detection signal in such a way that the first one of the at least two terminal impedance values is selected.

In a further preferred embodiment of the apparatus according to the first aspect of the invention, the control circuit is designed to receives an operation selection signal. The control circuit controls the terminal matching circuit responsive to the operation selection signal in such a way that the first one of the at least two terminal impedance values is selected when the apparatus is placed in the first situation and the second one of the at least two terminal impedance values is selected when the apparatus is placed in the second situation.

In this embodiment, it is preferred that the first one of the at least two terminal impedance values is selected when the operation selection signal is a signal ending voice message exchange or a disconnection signal sent from a remote apparatus, and the second one of the at least two terminal impedance values is selected when the operation selection signal is a signal starting voice message exchange.

As the operation selection signal, a signal indicating an operation state of the apparatus generated from the reception data may be used.

According to a second aspect of the present invention, an impedance matching method of a radio communication apparatus is provided. The apparatus comprises (i) a casing;

(ii) an antenna retractable into the casing;

the antenna having a first element and a second element joined together;

the first element being placed outside even when the antenna is retracted;

the second element being retracted into the casing when the antenna is retracted;

the second element being connected to an internal circuit provided in the casing;

(iii) a terminal matching circuit for matching an impedance of the antenna to that of the internal circuit; and (iv) a control circuit for controlling an operation of the terminal matching circuit.

The method according to the second aspect comprises the steps of:

(a) providing at least two terminal impedance values for the antenna to the terminal matching circuit so as to match the impedance of the antenna to that of the internal circuit in a first situation where an environment of the antenna is similar to a free space and a second situation where an environment of the antenna is dissimilar from a free space; and (b) operating the control circuit in such a way that a first one of the at least two terminal impedance values is selected when the apparatus is placed in the first situation and a second one of the at least two terminal impedance values is selected when the apparatus is placed in the second situation.

With the impedance matching method of a radio communication apparatus according to the second aspect of the invention, because of substantially the same reason, a desired impedance matching state between the retractable antenna and the inner circuit connected thereto can be realized in each of the first and second situations. Because of the impedance matching, the return loss of the antenna can be decreased.

If the at least two terminal impedance values for the antenna are properly set to meet the requirement when the antenna is retracted into the casing or not, a desired impedance matching state between the retractable antenna and the inner circuit can be realized in each of the first and second situations independent of whether the antenna is retracted or not.

In a preferred embodiment of the method according to the second aspect of the invention, the terminal matching circuit is configured to comprise a first termination subcircuit, a second termination subcircuit, and a switch. A control signal is sent from the control circuit to switch the first and second termination subcircuits.

In this embodiment, preferably, the first termination subcircuit is connected to the second element of the antenna when the apparatus is in the first situation, and the second termination subcircuit is connected to the second element of the antenna when the apparatus is in the second situation.

Alternately, the first termination subcircuit is connected to the second element of the antenna when the apparatus is in the first situation, and the fist and second termination subcircuits are connected to the second element of the antenna when the apparatus is in the second situation.

In another preferred embodiment of the method according to the second aspect of the invention, the first situation is set to include a stand-by state and a data communication state of the apparatus and the second situation is set to include a voice message exchange state.

In still another preferred embodiment of the method according to the second aspect of the invention, an earphone detection circuit outputting an earphone detection signal to the control circuit is additionally provided. The control circuit controls the terminal matching circuit responsive to the earphone detection signal in such a way that the first one of the at least two terminal impedance values is selected.

In a further preferred embodiment of the method according to the second aspect of the invention, the control circuit receives an operation selection signal. The control circuit controls the terminal matching circuit responsive to the operation selection signal in such a way that the first one of the at least two terminal impedance values is selected when the apparatus is placed in the first situation and the second one of the at least two terminal impedance values is selected when the apparatus is placed in the second situation.

In this embodiment, it is preferred that the first one of the at least two terminal impedance values is selected when the operation selection signal is a signal ending voice message exchange or a disconnection signal sent from a remote apparatus, and the second one of the at least two terminal impedance values is selected when the operation selection signal is a signal starting voice message exchange.

As the operation selection signal, a signal indicating an operation state of the apparatus generated from the reception data may be used.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
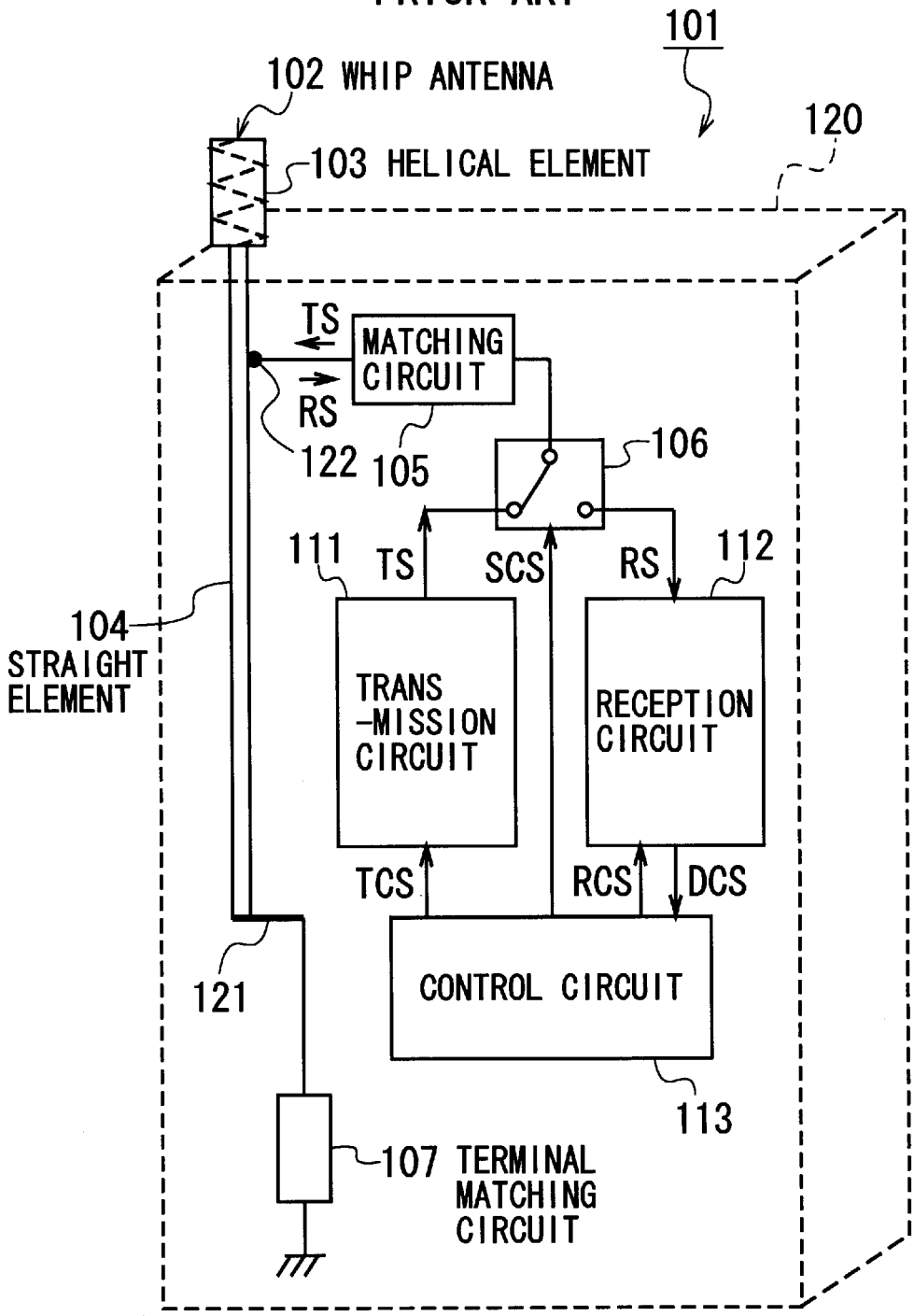
FIG. 1 PRIOR ART
FIG. 1 is a schematic, functional block diagram showing the configuration of a prior-art radio communication apparatus with a retractable whip antenna.
Figure 2:
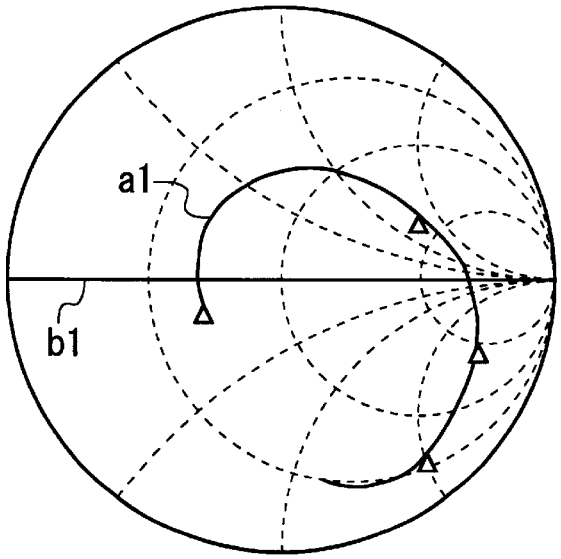
FIG. 2 PRIOR ART
FIG. 2 is a Smith chart indicating the input impedance characteristic of the antenna of the prior-art apparatus in FIG. 1 in a situation where the antenna is retracted into the casing and the apparatus is placed in the vicinity of the head of the user.
Figure 3:
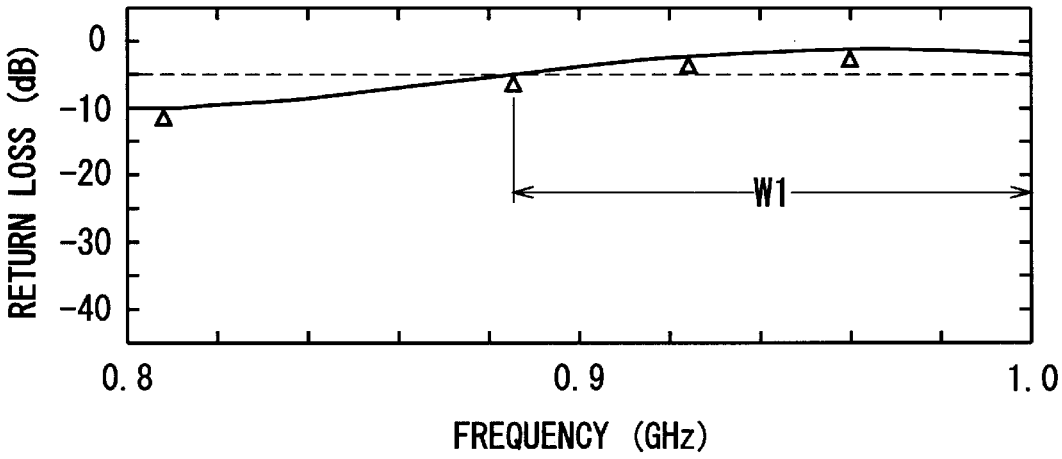
FIG. 3 PRIOR ART
FIG. 3 is a graph showing the return loss characteristic of the antenna of the prior-art apparatus in FIG. 1 in a situation where the antenna is retracted into the casing and the apparatus is placed in the vicinity of the head of the user.

Preferred embodiments of the present invention will be described in detail below while referring to the drawings attached.

First Embodiment

Figure 4:
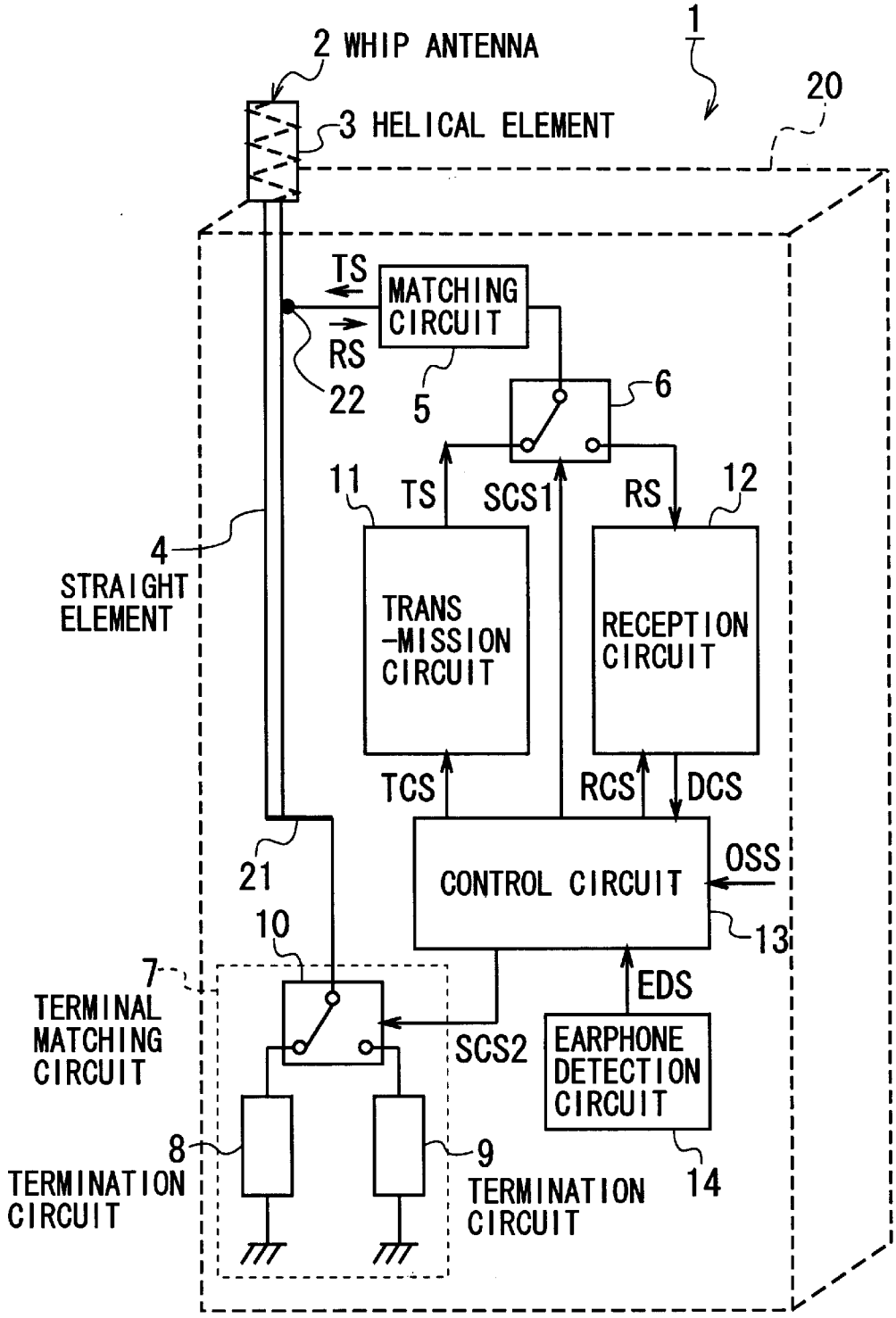
FIG. 4 is schematic, functional block diagram showing the configuration of a radio communication apparatus with a retractable whip antenna according to a first embodiment of the invention, in which the antenna is retracted into the casing.
Figure 5:
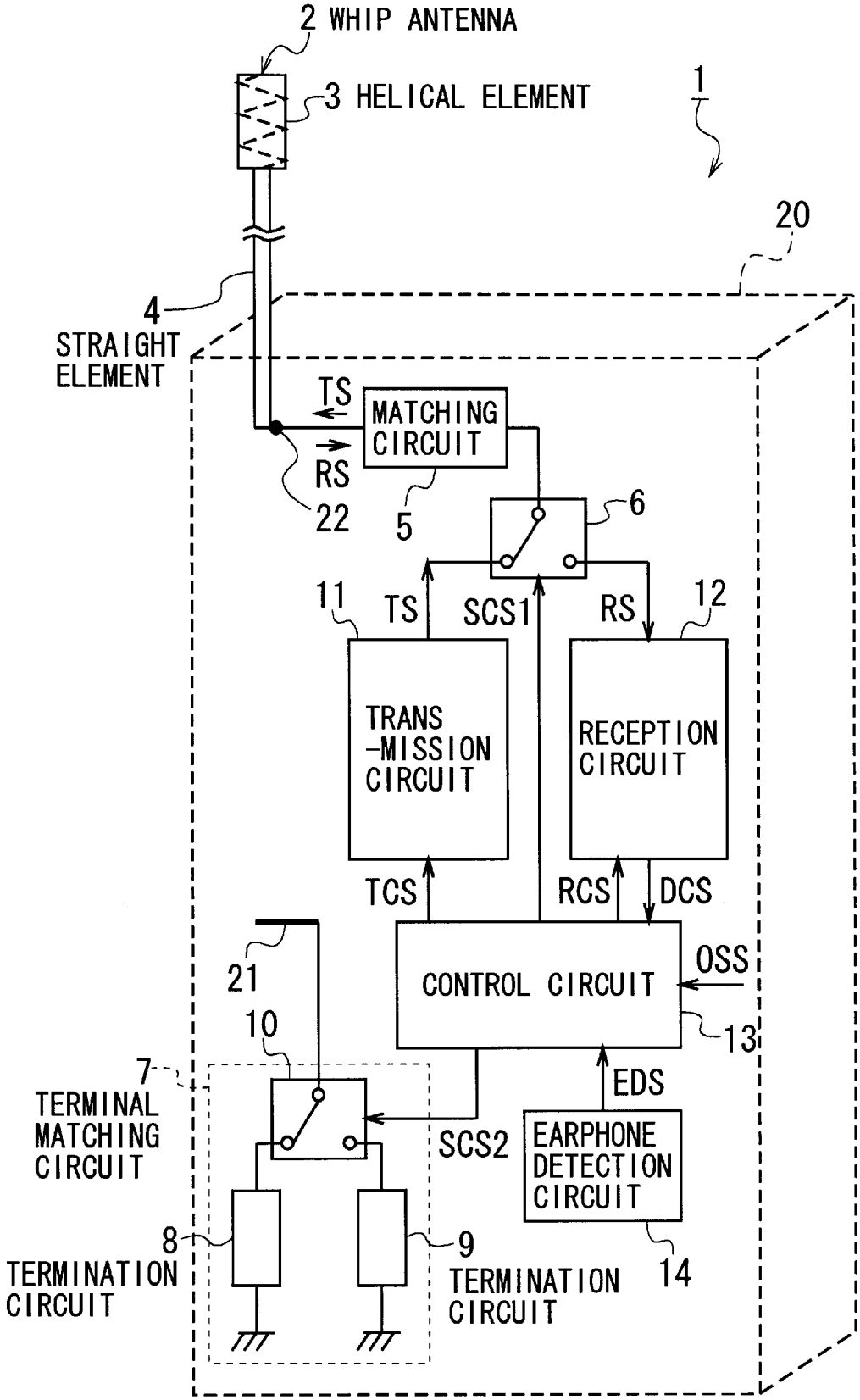
FIG. 5 is schematic, functional block diagram showing the configuration of the apparatus according to the first embodiment of FIG. 4, in which the antenna is extended from the casing.

A radio communication apparatus with a retractable whip antenna according to a first embodiment of the invention is shown in FIGS. 4 and 5, which is configured as a portable telephone.

The radio communication apparatus 1 according to the first embodiment comprises a whip antenna 2, a matching circuit 5, a three-terminal switch 6 for switching the transmission and reception operations, a terminal matching circuit 7, a transmission circuit 11, a reception circuit 12, a control circuit 13, an earphone detection circuit 14, and a casing 20.

The whip antenna 2 includes a straight element 4 and a helical element 3. The top end of the element 4 is joined to the bottom end of the element 3. The straight element 4 is retractable into the casing 20 as shown in FIG. 4 and is extendable from the casing 20 as shown in FIG. 5. The antenna 2 serves to radiate a transmission signal TS supplied from the transmission circuit 11 to the atmospheric air in the form of a radio wave. Also, the antenna 2 serves to receive a radio wave that has propagated through the atmospheric air and generates a reception signal RS from the wave thus received.

As shown in FIG. 4, when the straight element 4 is retracted into the casing 20 (i.e., the antenna 2 is retracted into the casing 20), only the helical element 3 is located outside the casing 20. On the other hand, when the straight element 4 is extended from the casing 20 (i.e., the antenna 2 is extended from the casing 20), both the helical and straight elements 3 and 4 are located outside the casing 20, as shown in FIG. 5.

The terminal matching circuit 7 comprises first and second termination circuits 8 and 9 and a three-terminal switch 10. The first terminal of the switch 10 is connected to a connector 21 and serves as the input terminal of the circuit 7. The second terminal of the switch 10 is connected to one terminal of the first termination circuit 8. The third terminal of the switch 10 is connected to one terminal of the second termination circuit 9. The other terminals of the circuits 8 and 9 are connected to the ground. The switch 10 connects one of the circuits 8 and 9 to the connector 21 alternately according to a switch control signal SCS2 supplied from the control circuit 13.

The impedance of the first termination circuit 8 has a value that optimizes the input impedance of the antenna 2 when the apparatus 1 is placed at a position apart from the head of a human body (i.e., the user of the apparatus 1) and at the same time, the antenna 2 is retracted into the casing 20 and the circuit 8 is connected to the straight element 4. The impedance of the second termination circuit 9 has a value that optimizes the input impedance of the antenna 2 when the apparatus 1 is placed at a position near the head of the user and at the same time, the antenna 2 is retracted into the casing 20 and the circuit 9 is connected to the straight element 4.

The matching circuit 5 is connected to the connector 22 while it is connected to the first terminal of the switch 6. The circuit 5 has a configuration enabling the impedance matching between the whip antenna 2 and the transmission or reception circuit 11 or 12.

As shown in FIG. 4, when the antenna 2 is retracted into the casing 20, the bottom end of the straight element 4 is in contact with the connector 21, thereby connecting the element 4 to the input terminal of the terminal matching circuit 7 (i.e., the first terminal of the switch 10). In this state, the upper part of the element 4 is in contact with the connector 22, thereby connecting the element 4 to the matching circuit 5.

Unlike this, as shown in FIG. 5, when the antenna 2 is extended from the casing 20, the bottom end of the straight element 4 is apart from the connector 21, thereby disconnecting the element 4 from the input terminal of the terminal matching circuit 7. In this state, however, the lower part of the element 4 is kept in contact with the connector 22, thereby keeping the electrical connection between the element 4 and the matching circuit 5.

The second and third terminals of the switch 6 are connected to the output terminal of the transmission circuit 11 and the input terminal of the reception circuit 12, respectively. The switch 6 connects one of the circuits 11 and 12 to the matching circuit 5 alternately by the switch control signal SCS1 supplied from the control circuit 13.

The transmission circuit 11 generates the transmission signal TS by modulating the carrier wave by the transmission data. The circuit 11 outputs from its output terminal the signal TS thus generated to the antenna 2 by way of the switch 6 and the matching circuit 5. The operation of the circuit 11 is controlled by the transmission control signal TCS sent from the control circuit 13.

The reception circuit 12 receives at its input terminal the reception signal RS generated by the antenna 2 by way of matching circuit 5 and the switch 6. The circuit 12 demodulated the signal RS and extracts the information or data contained therein. If the signal RS contains a disconnecting signal DCS, the circuit 12 extracts the signal DCS and sends it to the control circuit 13. The operation of the circuit 12 is controlled by the reception control signal RCS sent from the control circuit 13.

The earphone detection circuit 14 detects the connection of a specified earphone (not shown). Specifically, the circuit 14 detects the connection and disconnection of the plug of the earphone to the earphone jack (not shown) provided on the apparatus 1. If the plug is connected to the jack, the circuit 14 outputs an earphone detection signal EDS to the control circuit 13.

The control circuit 13 receives an operation selection signal OSS. The circuit 13 recognizes the operation state or condition on the basis of the operation selection signal OSS, the disconnection signal DCS, and the earphone detection signal EDS. According to the operation state thus recognized, the circuit 13 generates the switch control signals SCS1 and SCS2, the transmission control signal TCS, and the reception control signal RCS and then, it sends these signals SCS1, SCS2, TCS, and RCS to the switches 6 and 10 and the circuits 11 and 12, respectively.

As explained above, when the whip antenna 2 is extended, as shown in FIG. 5, both the helical and straight elements 3 and 4 are located outside the casing 20 and therefore, both the elements 3 and 4 are active. In this case, the bottom end of the element 4 is kept in electrical connection to the matching circuit 5 by way of the connector 22. The matching circuit 5 has a characteristic transmission or reception circuit 11 or 12 when the apparatus 1 is located in a situation like a free space and the antenna 2 is extended. As a result, the impedance between the antenna 2 and the circuit 11 or 12 is matched by the effect of the circuit 5.

On the other hand, when the antenna 2 is retracted, as shown in FIG. 4, only the helical element 3 is located outside the casing 20 and therefore, only the element 3 is substantially active. In this case, the input impedance of the antenna 2 is compensated with the terminal matching circuit 7. Specifically, the input impedance of the antenna 2 is compensated in such a way that the impedance matching is accomplished between the element 3 and the circuit 11 or 12. As a result, similar to the case where the antenna 2 is extended, the impedance matching between the antenna 2 and the circuit 11 or 12 is accomplished.

In the terminal matching circuit 7, one of the first and second termination circuits 8 and 9 is connected to the bottom of the straight element 4 through the switch 10 alternately. The switching operation of the switch 10 is accomplished by the switch control signal SCS2 sent from the control circuit 13. Thus, the first termination circuit 8 is connected to the element 4 in the first situation where the environment of the antenna 2 is similar to a free space while the second termination circuit 9 is connected the antenna 2 is dissimilar from a free space. In other words, the first termination circuit 8 having the impedance terminable for the helical element 3 in a place apart from the head of the user will be active in the first situation. The second termination circuit 9 having the impedance terminable for the element 3 in a place near the head of the user will be active in the second situation. Accordingly, the impedance is matched or optimized between the antenna 2 and the circuit 11 or 12 in each of the first and second situations.

Next, the operation of the radio communication apparatus 1 having the above-described configuration is explained below. The following explanation is made for the situation where the antenna 2 is retracted into the casing 20, as shown in FIG. 4.

In the transmission or reception operation, the switch 6 is operated or driven by the control circuit 13 according to the transmission or reception timing, thereby connecting the transmission or reception circuit 11 or 12 to the matching circuit 5. Specifically, in the transmission operation, the switch 6 is driven to connect the transmission circuit 11 to the matching circuit 5 by the control signal SCS1 and then, the transmission signal TS outputted from the circuit 11 is sent to the antenna 2 by way of the circuit 5 and transmitted therefrom into the atmospheric air in the form of a radio wave. On the other hand, in the reception operation, the switch 6 is driven to connect the reception circuit 12 to the matching circuit 5 by the control signal SCS1 and then, the reception signal RS generated by the antenna 2 from a radio wave received is sent to the circuit 12 by way of the circuit 5, reproducing the transmitted information through demodulation.

The terminal matching circuit 7 operates in the following way.

The three-terminal switch 10 in the circuit 7 is controlled according to the operating state of the apparatus 1. The user of the apparatus 1 can recognize the operating state by manipulating a specific operation button or key (not shown) provided on the apparatus 1, thereby sending the operation selection signal OSS to the control circuit 13.

In the stand-by state for waiting incoming messages or data, the first termination circuit 8 is connected to the straight element 4 by the action of the switch 10. The circuit 8 is kept connected to the straight element 4 through the switch 10 before the user presses a specific key or button (not shown) to make/receive a phone call provided on the apparatus 1.

On making a phone call to a remote radio communication apparatus, if the user dials and presses the key or button making/receiving a phone call, voice communication will start. At the same time as the pressing the key or button making/receiving a phone call, the switch 10 is driven by the control signal SCS2 outputted from the control circuit 13, thereby connecting the second termination circuit 9 to the element 4 instead of the first termination circuit 8. This connection state between the circuit 9 and the element 4 is kept during the operation of making a phone call.

If the user presses the key or button making/receiving a phone call during the voice communication, the phone call and voice communication are ended and at the same time, the switch 10 is operated to reconnect the first termination circuit 8 to the element 4. Thus, the first termination circuit 8 is connected to the element 4 again.

The reception circuit 12 might receive a specific disconnection signal DCS sent from the remote radio communication apparatus during the voice communication. In this case, the same operation as that of pressing the key or button making/receiving a phone call is performed and then, the first termination circuit 8 is reconnected to the element 4. When the reception circuit 12 receives the disconnection signal DCS, the circuit 12 outputs the signal DCS to the control circuit 13.

On receiving a phone call from a remote radio communication apparatus, if the user presses the key or button making/receiving a phone call, voice communication starts. At the same time, the switch 10 is driven by the control signal SCS2, thereby connecting the second termination circuit 9 to the element 4 instead of the first termination circuit 8. This connection state between the circuit 9 and the element 4 is kept during the voice communication.

If the user presses the specific key or button making/receiving a phone call during the voice communication, the voice communication is ended and the switch 10 is operated to reconnect the first termination circuit 8 to the element 4.

The reception circuit 12 might receive a specific disconnection signal DCS sent from the remote radio communication apparatus during the voice communication. In this case, the same operation as that of pressing the key or button making/receiving a phone call is performed and then, the first termination circuit 8 is reconnected to the element 4.

In addition, the earphone plug is connected to the earphone jack of the apparatus 1, the earphone detection circuit 14 outputs the detection signal EDS to the control circuit 13. In this case, even if the apparatus 1 is in the voice communication operation, the switch 10 is driven by the control signal SCS2 to thereby connect the first termination circuit 8 to the element 4. This is because the apparatus 1 is usually located at a point apart from the head of the user when the earphone is used.

Similarly, when the apparatus 1 is used for data transmission, the switch 10 is driven by the control signal SCS2, thereby connecting the first termination circuit 8 to the element 4. This may be accomplished by a signal informing the fact that a specific data transmission device is connected to the data transmission terminal (not shown) of the apparatus 1 or that the Central Processing Unit (CPU) incorporated into the apparatus 1 carries out specific data transmission processes.

Figure 6:
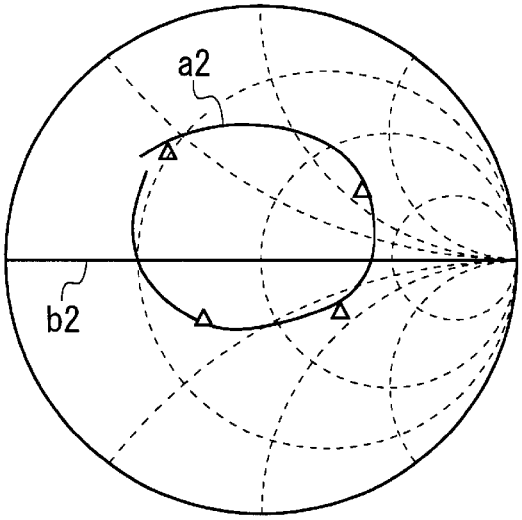
FIG. 6 is a Smith chart indicating the input impedance characteristic of the antenna of the apparatus according to the first embodiment of FIG. 4 in a situation where the antenna is retracted into the casing and the apparatus is placed apart from the head of the user.
Figure 7:
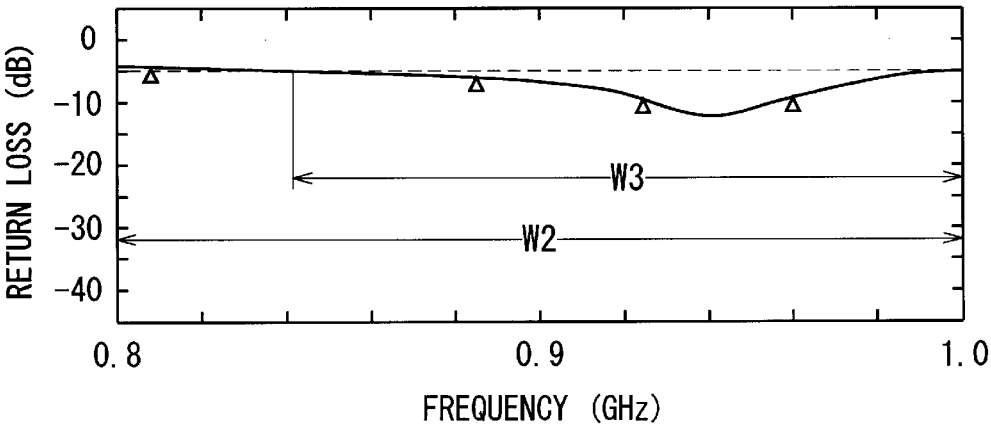
FIG. 7 is a graph showing the return loss characteristic of the antenna of the apparatus according to the first embodiment of FIGS. 4 and 5 in a situation where the antenna is retracted into the casing and the apparatus is placed apart from the head of the user.

As described above, when the apparatus 1 is used in the first situation where the environment of the antenna 2 can be approximated as a free space (such as the stand-by and dialing-in states), the straight element 4 of the antenna 2 is connected to the first termination circuit 8 by way of the switch 10, resulting in excellent characteristics of the antenna 2, as shown in FIGS. 6 and 7.

FIG. 6 is a Smith chart indicating the input impedance of the whip antenna 2 (substantially, the helical element 3) in the second situation where the apparatus 1 is apart from the head of the user. As seen from FIG. 6, the shift of the curve a2 showing the input impedance from the center line b2 is smaller than that of the prior-art apparatus 101, which means that the input impedance characteristic of the antenna is improved.

FIG. 7 is a graph showing the return loss characteristic between the antenna 2 (substantially, the helical element 3)

and the transmission or reception circuit 11 or 12 in the first situation where the circuit environment can be approximated as a free space. As seen from FIG. 7, the return loss is approximately less than the reference value of −5 dB in the frequency range W2 and is completely less than the reference value in the frequency range W3. This means that the return loss is also improved.

On the other hand, when the apparatus 1 is used in a location where the environment of the antenna 2 cannot be approximated as a free space (i.e., the second situation), the straight element 4 of the antenna 2 is connected to the second termination circuit 9 by way of the switch 10. In this case also, the antenna 2 provides excellent characteristics, as shown in FIGS. 8 and 9.

Figure 8:
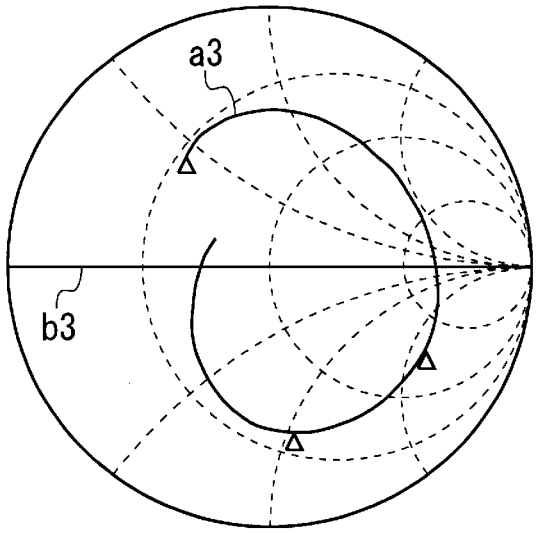
FIG. 8 is a Smith chart indicating the input impedance characteristic of the antenna of the apparatus according to the first embodiment of FIGS. 4 and 5 in a situation where the antenna is retracted into the casing and the apparatus is placed near the head of the user.

FIG. 8 is a Smith chart indicating the input impedance of the antenna 2 (substantially, the helical element 3) in the second situation where the apparatus 1 is in the vicinity of the head of the user. As seen from FIG. 8, the shift of the curve a3 showing the input impedance from the center line b3 is smaller than the prior-art apparatus 101, which means that the input impedance characteristic is improved.

Figure 9:
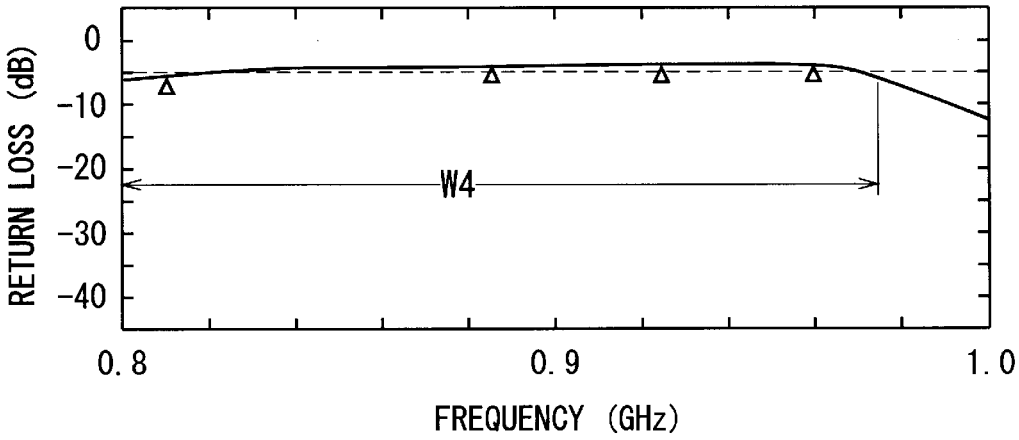
FIG. 9 is a graph showing the return loss characteristic of the antenna of the apparatus according to the first embodiment of FIGS. 4 and 5 in a situation where the antenna is retracted into the casing and the apparatus is placed near the head of the user.

FIG. 9 is a graph showing the return loss characteristic between the antenna 2 (substantially, the helical element 3) and the transmission or reception circuit 11 or 12 in second situation. As seen from FIG. 9, the return loss is approximately less than the reference value of −5 dB in the frequency range W4. This means that the return loss is also improved.

The terminal matching circuit 7 having the above-identified behavior can be realized by various known configurations. An example of the circuit 7 is explained below with reference to FIG. 10.

Next, an example of the terminal matching circuit 7 is explained below with reference to FIG. 10.

Figure 10:
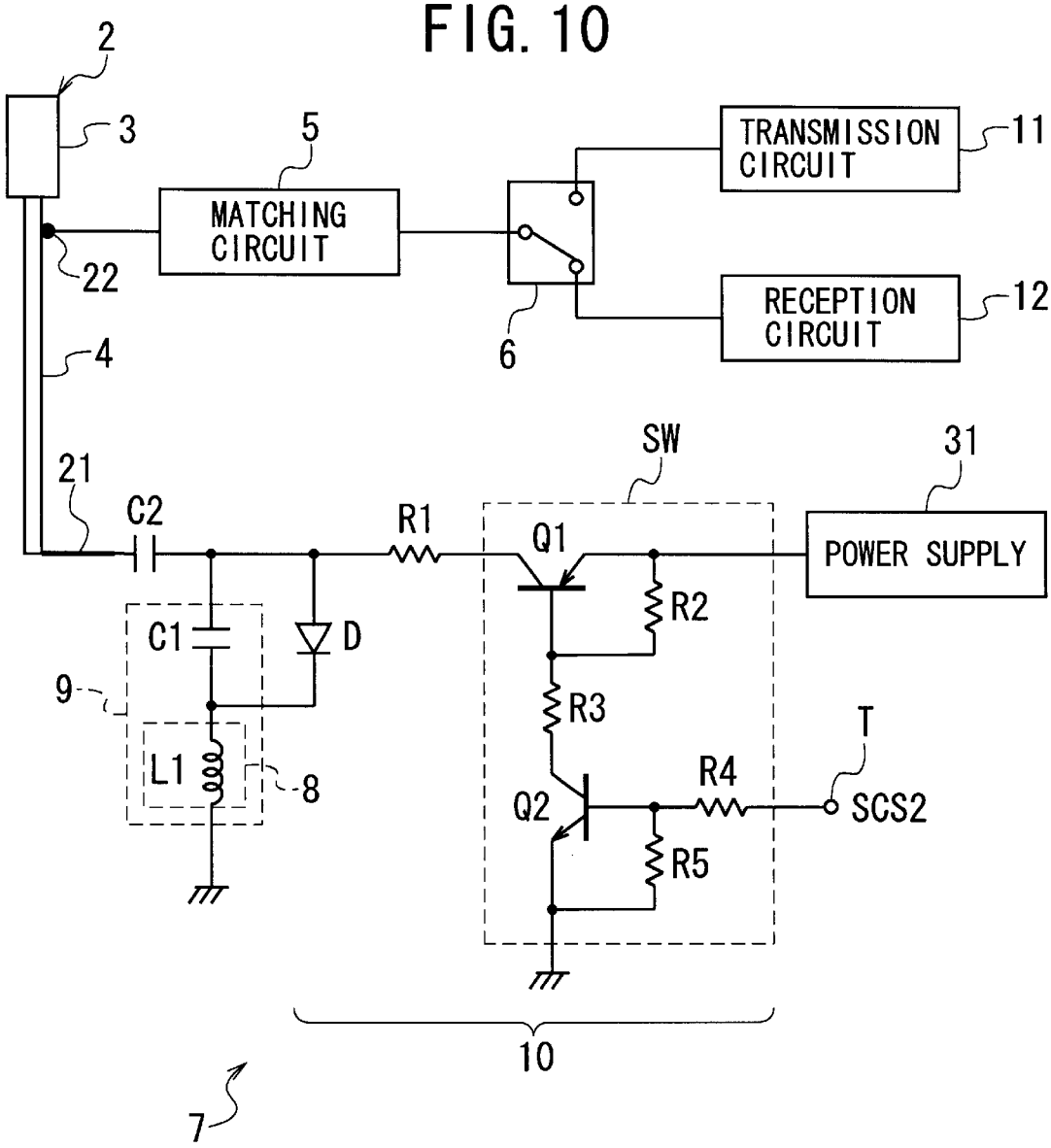
FIG. 10 is a circuit diagram showing an example of the terminal matching circuit used in the apparatus according to the first embodiment of FIGS. 4 and 5.

As shown in FIG. 10, the terminal matching circuit 7 comprises two capacitors C1 and C2, an inductor L1, a diode D, five resistors R1, R2, R3, R4, and R5, a npn-type bipolar transistor Q1, and a pnp-type bipolar transistor Q2. The capacitor C1 and the diode D are connected in parallel. The terminals coupled of the capacitor C1 and the diode D are connected to the connector 21 by way of the capacitor C2 and to the collector of the transistor Q1 by way of the resistor R1. The other terminals coupled of the capacitor C1 and the diode D are connected to the ground by way of the inductor L1.

The emitter of the transistor Q1 is connected to its base by way of the resistor R2 and to a power supply 31 directly. The base of the transistor Q1 is connected to the collector of the transistor Q2 by way of the resistor R3. The base of the transistor Q2 is connected to its emitter by way of the resistor R5 and to an input terminal T by way of the resistor R4. The terminal T receives the switch control signal SCS2 sent from the control circuit 13. The emitter of the transistor Q2 is directly connected to the ground.

The inductor L1 constitutes the first termination circuit 8. The combination of the capacitor C1 and the inductor L1 constitute the second termination circuit 9. The transistors Q1 and Q2 and the resistors R2, R3, R4, and R5 constitute a switch SW for switching the ON and OFF operations of the diode D. The diode D, the resistor R1, and the switch SW constitute the switch 10 for switching the first and second termination circuits 8 and 9.

The resistor R1 serves to limit the current flowing through the diode D. The capacitor C2 serves to lower the impedance of the terminal matching circuit 7 within the operating frequency range of the apparatus 1. The capacitance of the capacitor C2 is adjusted or determined so as to make the impedance of the circuit 7 sufficiently low.

With the terminal matching circuit 7 having the above-described configuration, when the switch control signal SCS2 from the control circuit 13 is in the logic low (L) state, the switch SW is turned OFF and as a result, no current flows through the diode D. Thus, the combination of the capacitor C1 and the inductor L1 is connected to the straight element 4 of the antenna 2 by way of the connector 21. On the other hand, when the switch control signal is in the logic high (H) state, the switch SW is turned ON and as a result, a specific current flows through the diode D. Thus, only the inductor L1 is connected to the straight element 4 by way of the connector 21.

The diode D has a characteristic that the ON-state impedance decreases as the current flowing through the diode D increases. Taking this characteristic into consideration, the resistance of the resistor R1 is determined in such a way that the ON-state impedance of the diode D has a desired value due to the current flowing through the diode D.

Because of the above-described configuration, a current flows through the terminal matching circuit 7 only when the microphone and the receiver (or speaker) are used, i.e., the apparatus 1 is in the second situation where the apparatus is located near the head of the user. Thus, there is an additional advantage that current consumption is saved in the stand-by and data transmission states.

The capacitance of the capacitor C2 is adjusted to a proper value according to the desired frequency ranges. For example, if the apparatus 1 is designed for the use in an operating frequency range of approximately 800 MHz, it is preferred to set at approximately 100 pF.

Since the diode D is used to switch the first and second termination circuits 8 and 9, the switch SW is necessary in the configuration of FIG. 10. However, if the diode D is formed by a proper element (e.g., a GaAs switching element) that is controllable directly by the control circuit 13, there arises an additional advantage that the switch SW can be canceled and the configuration is simplified.

With the radio communication apparatus 1 according to the first embodiment of FIGS. 4 and 5, as explained above in detail, the terminal matching circuit 7 includes the first termination circuit 8 for the situation where the apparatus 1 is apart from the head of the user, the second termination circuit 9 for the second situation where the apparatus 1 is near the head of the user, and the switch 10 for switching the circuits 8 and 9. Due to the operation of the switch 10, one of the circuits 8 and 9 is alternately connected to the straight element 4 of the antenna 2. Thus, the input impedance of the antenna 2 is properly compensated in each of the first and second situations, thereby realizing impedance matching and decreasing the return loss in these two situations.

Second Embodiment

Figure 11:
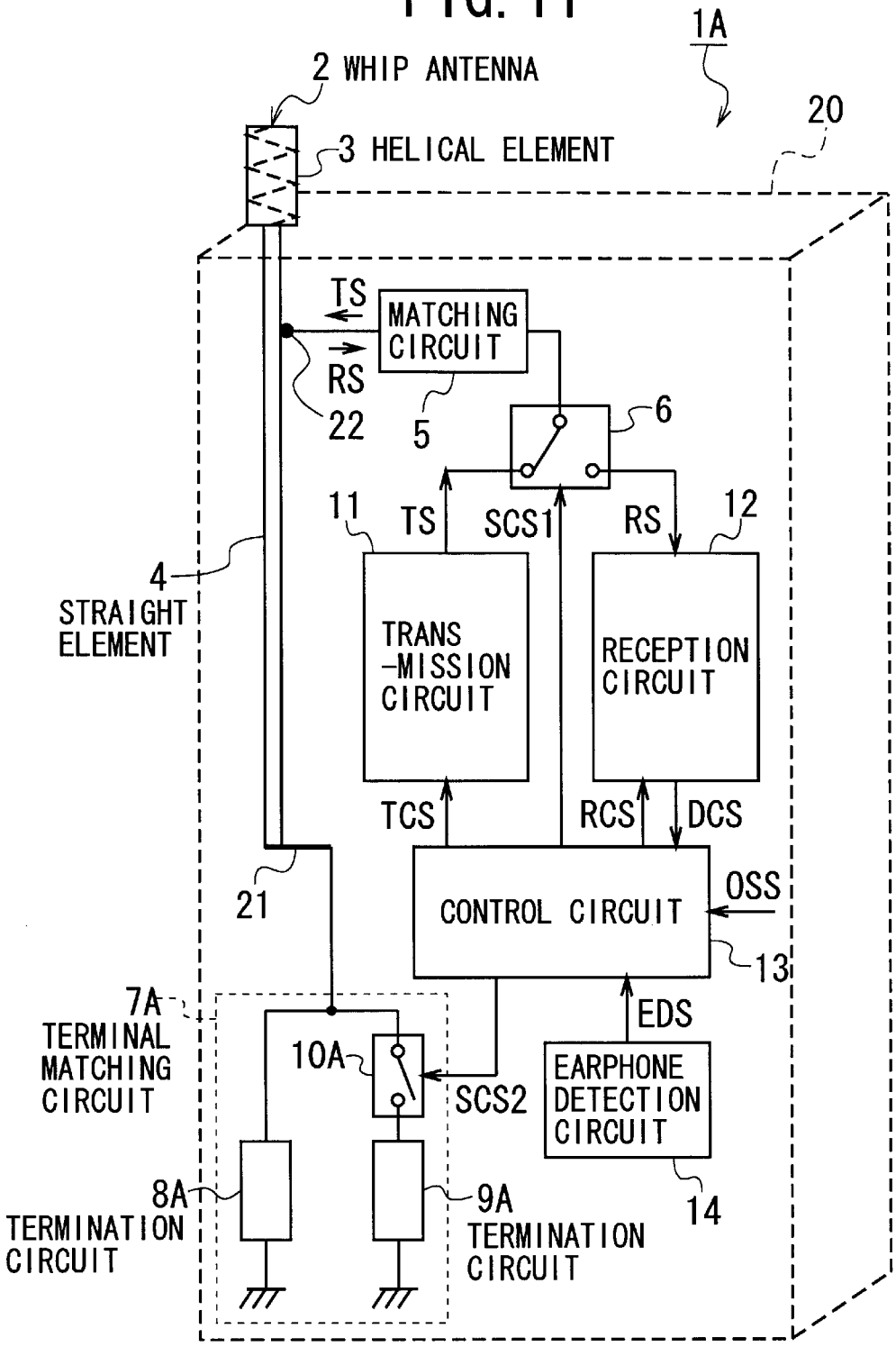
FIG. 11 is a schematic, functional block diagram showing the configuration of a radio communication apparatus with a retractable whip antenna according to a second embodiment of the invention, in which the antenna is retracted into the casing.

FIG. 11 shows a radio communication apparatus 1A according to a second embodiment of the present invention, which includes the same configuration as that of the first embodiment of FIGS. 4 and 5 except that a terminal matching circuit 7A is used instead of the terminal matching circuit 7. Therefore, the explanation about the same configuration is omitted here for the sake of simplification by attaching the same reference symbols as used in the first embodiment in FIG. 11.

The terminal matching circuit 7A comprises a first termination circuit 8A, a second termination circuit 9A, and a two-terminal switch 10A. One terminal of the circuit 8A is directly connected to the connector 21 and its other terminal is connected to the ground. One terminal of the switch 10A is directly connected to the connector 21 and its other terminal is connected to the ground by way of the circuit 9A.

The switch 10A is turned ON or OFF by the switch control signal SCS2 from the control circuit 13.

When the switch 10A is turned OFF in the state where the whip antenna 2 is retracted into the casing 20, the first termination circuit 8A is connected to the straight element 4 of the antenna 2 by way of the connector 21. When the switch 10A is turned ON in the same state, the first and second termination circuits 8A and 9A are connected in parallel to the straight element 4 by way of the connector 21.

The first termination circuit 8A has an impedance that optimizes the input impedance of the antenna 2 in the first situation where the apparatus 1 is apart from the head of the user and the whip antenna 2 is retracted. The impedance of the second termination circuit 9A is determined in such a way that the total impedance of the circuits 8A and 9A optimizes the input impedance of the antenna 2 in the second situation where the apparatus 1 is near the head of the user and the whip antenna 2 is retracted.

Next, the operation of the radio communication apparatus 1A according to the second embodiment is explained below.

On making a phone call to a remote radio communication apparatus and receiving a phone call from a remote radio communication apparatus, the control circuit 13 drives the switch 6 according to the transmission or reception timing to thereby connect one of the transmission and reception circuits 11 and 12 to the matching circuit 5. This is the same as that of the first embodiment.

In the terminal matching circuit 7A, the switch 10A is controlled according to the operation state of the apparatus 1A similar to the apparatus 1 according to the first embodiment.

Specifically, in the stand-by state for waiting incoming messages or data, the switch 10A is kept OFF and as a result, only the first termination circuit 8A is connected to the straight element 4. Only the circuit 8A is kept connected to the straight element 4 before the user presses the specific key or button making/receiving a phone call, voice communication will start.

On making a phone call to a remote apparatus, the user presses the key or button making/receiving a phone call. At this time, the switch 10A is turned ON by the control signal SCS2, thereby connecting the second termination circuit 9A to the element 4 along with the first termination circuit 8A. This connection state between the circuits 8A and 9A and the element 4 is kept during the voice communication operation.

If the user presses the key or button making/receiving a phone call or the reception circuit 12 receives a specific disconnection signal DCS from the remote radio communication apparatus during the voice communication, the phone call and voice communication are ended and at the same time, the switch 10A is turned OFF to reconnect the first termination circuit 8A to the element 4. Thus, only the first termination circuit 8A is connected to the element 4 again.

On receiving a phone call from a remote radio communication apparatus, if the user presses the key or button making/receiving a phone call, voice communication starts. At the same time, the switch 10A is turned ON by the control signal SCS2, thereby connecting the second termination circuit 9 to the element 4 along with the first termination circuit 8. This connection state between the circuits 8 and 9 and the element 4 is kept during the voice communication.

If the user presses the specific key or button making/receiving a phone call or the reception circuit 12 receives the specific disconnection signal DCS sent from the remote radio communication apparatus during the voice communication, the voice communication is ended and the switch 10A is turned OFF to disconnect the second termination circuit 9 from the element 4 while the first termination circuit 8 is kept connected to the element 4.

If the earphone plug is connected to the earphone jack of the apparatus 1A, the earphone detection circuit 14 outputs the detection signal EDS to the control circuit 13. In this case, even if the apparatus 1A is in the voice communication operation, the switch 10A is turned OFF by the control signal SCS2, thereby disconnecting the second termination circuit 9A from the element 4. This is because the apparatus 1A is usually located at a point apart from the head of the user when the earphone is used.

Similarly, when the apparatus 1A is used for data transmission, the switch 10A is turned OFF by the control signal SCS2, thereby disconnecting the second termination circuit 9A from the element 4. This may be accomplished by a signal informing the fact that a specific data transmission device is connected to the data transmission terminal (not shown) of the apparatus 1A or that the CPU incorporated into the apparatus 1A conducts specific data transmission processes.

As described above, when the apparatus 1A according to the second embodiment is used in a location (such as the stand-by, dialing-in, and data-transmission states) where the environment of the antenna 2 can be approximated as a free space, the straight element 4 of the antenna 2 is connected to only the first termination circuit 8A, resulting in similar excellent characteristics of the antenna 2 to those in the first embodiment.

On the other hand, when the apparatus 1A is used in a location where the environment of the antenna 2 cannot be approximated as a free space, the straight element 4 of the antenna 2 is connected to both the first and second termination circuits 8A and 9A. In this case also, the antenna 2 provides similar excellent characteristics as those in the first embodiment.

With the radio communication apparatus 1A according to the second embodiment, as explained above in detail, the first termination circuit 8A is made active for the first situation where the apparatus 1A is apart from the head of the user and both the first and second termination circuits 8A and 9A are made active for the second situation where the apparatus 1A is near the head of the user through the operation of the switch 10A. Thus, the input impedance of the antenna 2 is properly compensated in each of the two situations, thereby realizing impedance matching and decreasing the return loss in each of the two situations.

VARIATIONS

In the above-described first and second embodiments, the terminal matching circuit 7 or 7A is controlled according to the operation state of the radio communication apparatus 1 or 1A. However, the present invention is not limited to this configuration. For example, the control of the switch 7 or 7A may be accomplished by demodulating the reception data generated from the information transmitted from a base station and judging whether the apparatus 1 or 1A is in any one of the situation where the apparatus 1 or 1A is apart from the head of the user and that where it is near the head of the user.

Moreover, the bottom end of the straight element 4 of the antenna 2 is connected to the terminal matching circuit 7 or 7A in the above-described first and second embodiments. However, needless to say, any other position of the element 4 than its bottom end may be connected to the circuit 7 or 7A. In this case, the first termination circuit 8 or 8A and the second termination circuit 9 or 9A are designed to have proper impedance that optimize the input impedance of the antenna 2 in each of the two situations.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A radio communication apparatus comprising:

(a) a casing;

(b) an antenna retractable into said casing;

said antenna having a first element and a second element joined together;

said first element being placed outside even when said antenna is retracted;

said second element being retracted into said casing when said antenna is retracted;

said second element being connected to an internal circuit provided in said casing;

(c) a terminal matching circuit for matching an impedance of said antenna to that of said internal circuit in a first situation where an environment of said antenna is similar to a free space and in a second situation where an environment of said antenna is dissimilar from a free space;

said terminal matching circuit being configured to provide at least two terminal impedance values for said antenna both in the extended state and in the retracted state; and (d) a control circuit for controlling an operation off said terminal matching circuit corresponding to whether said apparatus is placed in said first situation or said second situation;

said control circuit controlling said terminal matching circuit in such a way that a first one of the at least two terminal impedance values is selected when said apparatus is placed in said first situation and a second one of the at least two terminal impedance values is selected when said apparatus is placed in said second situation.

2. The apparatus according to claim 1, wherein said terminal matching circuit comprises a first termination subcircuit, a second termination subcircuit, and a switch for switching said first and second termination subcircuits by a control signal from said control circuit.

3. The apparatus according to claim 2, wherein said first termination subcircuit is connected to said second element of said antenna when said apparatus is said the first situation, and said second termination subcircuit is connected to said second element of said antenna when said apparatus is in said second situation.

4. The apparatus according to claim 2, wherein said first termination subcircuit is connected to said second element of said antenna when said apparatus is in said first situation, and said first and second termination subcircuits are connected to said second element of said antenna when said apparatus is in said second situation.

5. The apparatus according to claim 1, wherein said first situation includes a stand-by state and a data communication state of said apparatus and said second situation includes a voice message exchange state.

6. The apparatus according to claim 1, further comprising an earphone detection circuit outputting an earphone detection signal to said control circuit;

and wherein said control circuit controls said terminal matching circuit responsive to said earphone detection signal in such a way that said first one of the at least two terminal impedance values is selected.

7. The apparatus according to claim 1, wherein said control circuit is designed to receives an operation selection signal;

and wherein said control circuit controls said terminal matching circuit responsive to said operation selection signal in such a way that the first one of the at least two terminal impedance values is selected when said apparatus is placed in said first situation and the second one of the at least two terminal impedance values is selected when said apparatus is placed in said second situation.

8. The apparatus according to claim 7, wherein the first one of the at least two terminal impedance values is selected when said operation selection signal is a signal ending voice message exchange or a disconnection signal sent from a remote apparatus, and the second one of the at least two terminal impedance values is selected when said operation selection signal is a signal starting voice message exchange.

9. The apparatus according to claim 7, wherein a signal indicating an operation state of said apparatus generated from said reception data is used.

10. An impedance matching method of a radio communication apparatus, said apparatus comprising:

(i) a casing;

(ii) an antenna retractable into said casing;

said antenna having a first element and a second element joined together;

said first element being placed outside even when said antenna is retracted;

said second element being retracted into said casing when said antenna is retracted;

said second element being connected to an internal circuit provided in said casing;

(iii) a terminal matching circuit for matching an impedance of said antenna to that of said internal circuit; and (iv) a control circuit for controlling an operation of said terminal matching circuit:

said method comprising the steps of:

(a) providing at least two terminal impedance values for said antenna to said terminal matching circuit so as to match said impedance of said antenna to that of said internal circuit in a first situation where an environment of said antenna is similar to a free space and in a second situation where an environment of said antenna is dissimilar from a free space, said at least two terminal impedance values being provided for both the first and second situations both in the retracted state and in the extended state; and (b) operating said control circuit in such a way that a first one of the at least two terminal impedance values is selected when said apparatus is placed in said first situation and a second one of the at least two terminal impedance values is selected when said apparatus is placed in said second situation.

11. The method according to claim 10, wherein said terminal matching circuit is configured to comprise a first termination subcircuit, a second termination subcircuit, and a switch;

and wherein a control signal is sent from said control circuit to switch said first and second termination subcircuits.

12. The method according to claim 11, wherein said first termination subcircuit is connected to said second element of said antenna when said apparatus is in said first situation, and said second termination subcircuit is connected to said second element of said antenna when said apparatus in said second situation.

13. The method according to claim 11, wherein said first termination subcircuit is connected to said second element of said antenna when said apparatus is in said first situation, and said fist and second termination subcircuits are connected to said second element of said antenna when said apparatus is in said second situation.

14. The method according to claim 10, wherein said first situation is set to include a stand-by state and a data communication state of said apparatus and said second situation is set to include a voice message exchange state.

15. The method according to claim 10, wherein an earphone detection circuit outputting an earphone detection signal to said control circuit is provided;

wherein said control circuit controls said terminal matching circuit responsive to said earphone detection signal in such a way that the first one of the at least two terminal impedance values is selected.

16. The method according to claim 10, wherein said control circuit receives an operation selection signal;

and wherein said control circuit controls said terminal matching circuit responsive to said operation selection signal in such a way that the first one of the at least two terminal impedance values is selected when said apparatus is placed in said first situation and the second one of the at least two terminal impedance values is selected when said apparatus is placed in said second situation.

17. The method according to claim 16, wherein the first one of the at least two terminal impedance values is selected when said operation selection signal is a signal ending voice message exchange or a disconnection signal sent from a remote apparatus, and the second one of the at least two impedance values is selected when said operation selection signal is a signal starting voice message exchange.

18. The method according to claim 16, wherein a signal indicating an operation state of said apparatus generated from said reception data is used as said operation selection signal.

* * * * *